US010946426B2

(12) United States Patent
Perrot et al.

(10) Patent No.: US 10,946,426 B2
(45) Date of Patent: Mar. 16, 2021

(54) FORMING A BEND IN A CORRUGATION

(71) Applicant: GAZTRANSPORT ET TECHNIGAZ, Saint Remy les Chevreuse (FR)

(72) Inventors: Olivier Perrot, Etampes (FR); Thomas Conejero, Guyancourt (FR); Frèdèric Goslis, Mousseaux sur Seine (FR); Cyril Nota, Verneuil sur Seine (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 414 days.

(21) Appl. No.: 15/776,338

(22) PCT Filed: Nov. 21, 2016

(86) PCT No.: PCT/FR2016/053035
§ 371 (c)(1),
(2) Date: May 15, 2018

(87) PCT Pub. No.: WO2017/085435
PCT Pub. Date: May 26, 2017

(65) Prior Publication Data

US 2018/0297097 A1 Oct. 18, 2018

(30) Foreign Application Priority Data

Nov. 19, 2015 (FR) ..... 1561137

(51) Int. Cl.
*B21D 13/02* (2006.01)
*B21D 11/20* (2006.01)
(Continued)

(52) U.S. Cl.
CPC ..... *B21D 11/206* (2013.01); *B21D 11/10* (2013.01); *B21D 13/02* (2013.01); *B21D 13/10* (2013.01); *F17C 3/06* (2013.01)

(58) Field of Classification Search
CPC ..... B21D 11/206; B21D 11/10; B21D 13/02; B21D 13/10; B21D 13/00; B21D 11/20;
(Continued)

(56) References Cited

U.S. PATENT DOCUMENTS 3,760,624 A * 9/1973 Robinson ..... B21D 13/00 72/385
3,874,214 A * 4/1975 Racicot ..... B21D 13/02 72/307
(Continued)

FOREIGN PATENT DOCUMENTS

FR 879977 3/1943
FR 879977 A * 3/1943 ..... B21D 11/18
(Continued)

OTHER PUBLICATIONS

English-language International Search Report of International Application No. PCT/FR2016/053035.

*Primary Examiner* — Adam J Eiseman
*Assistant Examiner* — Amer Islam
(74) *Attorney, Agent, or Firm* — Blank Rome LLP

(57) ABSTRACT

The invention concerns a forming device intended to form a bend in a corrugation, the forming device comprising:

a bottom frame (4) having a planar mounting surface (6) intended to receive a sheet metal plate having a corrugation projecting relative to a planar portion of the sheet metal plate, a projecting counter-form (5) arranged on the mounting surface and intended to be accommodated in the corrugation, the projecting counter-form having a stationary portion (7) and a movable portion (8) that is hinged, relative to the stationary portion, about an axis perpendicular to the mounting surface, a top frame (34) arranged above the bottom frame,
(Continued)

a press configured to lower the top frame towards the bottom frame, and a hollow upper die carried by the top frame between the top frame (34) and the bottom frame (4), the hollow upper die (36, 37) being arranged above the movable portion of the projecting counter-form.

22 Claims, 13 Drawing Sheets

(51) Int. Cl.
*B21D 13/10* (2006.01)
*F17C 3/06* (2006.01)
*B21D 11/10* (2006.01)

(58) Field of Classification Search
CPC ..... B21D 31/005; B21D 37/06; B21D 37/08; B21D 37/10; F17C 3/06
See application file for complete search history.

(56) References Cited

U.S. PATENT DOCUMENTS

| | | | | | |
|---|---|---|---|---|---|
| 4,052,948 | A * | 10/1977 | Straza | ..... | B21D 13/10 72/305 |
| 7,040,001 | B1 * | 5/2006 | Chuang | ..... | B21D 13/10 29/34 R |
| 2010/0252954 | A1 * | 10/2010 | Yang | ..... | B21D 13/02 264/282 |

FOREIGN PATENT DOCUMENTS

| | | | | | |
|---|---|---|---|---|---|
| KR | 2010 0034795 | A | 4/2010 | | |
| KR | 20100034795 | A * | 4/2010 | ..... | B21D 11/18 |
| WO | WO 2011/048300 | A1 | 4/2011 | | |
| WO | WO 2013/010293 | A1 | 1/2013 | | |
| WO | WO-2013010293 | A1 * | 1/2013 | ..... | B21D 13/02 |

* cited by examiner

FORMING A BEND IN A CORRUGATION

This application is a U.S. National Stage Application of International Application No. PCT/FR2016/053035, filed Nov. 21, 2016, which claims priority to French Application No. 1561137, filed Nov. 19, 2015, which is incorporated herein by reference in its entirety.

TECHNICAL FIELD

The invention relates to the field of forming metal sheets, and more particularly to the working of a metal sheet that has one or more corrugations that need to be bent, i.e. a corrugation of which the longitudinal orientation is to be at least partially changed.

TECHNOLOGICAL BACKGROUND

Metal sheets having planar portions and protruding corrugations arranged between the planar portions are widely used in order to produce sealed membranes that need to undergo major temperature differences during use. Such corrugations are commonly formed by folding in straight orientations, for example in the form of two series of intersecting corrugations extending respectively in the length direction and the width direction of a rectangular metal sheet.

In order to produce a sealed assembly between two metal sheets that have corrugations, the positions of the respective corrugations of each of two metal sheets must coincide exactly along the assembly edge. For this reason, or in order to produce certain specific geometries, it is necessary to form corrugations of which the orientation changes or bends, for example to produce a continuous corrugation that runs around the entire periphery of the bottom wall of a cylindrical tank.

In order to form a metal sheet that has a bent corrugation, drawing methods are known, for example from KR-A-2010034795.

WO-A-2013010293 describes a tool for forming a corrugated metal sheet, in which a corrugation has a main straight portion and two end portions, and in which the end portions have a different angle of inclination to the main portion.

FR-A-879977 describes a device for bending a long, hollow profiled part.

SUMMARY

One idea underlying the invention is that of forming a metal sheet that has a bent corrugation and that is suitable for producing high-quality sealed assemblies. For this reason, methods and apparatuses are needed that can be used for forming a bent corrugation without affecting the flatness of the planar portions of the metal sheet. There is also a need for methods and apparatuses that can be used to bend a corrugation without affecting the cross-sectional shape of the corrugation. There is also a need for methods and apparatuses that can be used to bend a corrugation while minimizing the effects on the thickness of the metal sheet and the uniformity of same.

Therefore, the invention provides a sheet metal forming method intended to form a bend in a corrugation, the method comprising:

arranging a sheet metal plate on a bottom frame having a planar mounting surface and a projecting counter-form arranged on the mounting surface, the projecting counter-form having a stationary portion and a movable portion that is hinged, relative to the stationary portion, about an axis perpendicular to the mounting surface, the sheet metal plate having planar portions received on the mounting surface and a corrugation arranged between the planar portions, projecting relative to the planar portions and in which the projecting counter-form is accommodated, lowering a top frame arranged above the bottom frame towards the bottom frame, by means of a press, the top frame carrying a hollow upper die arranged above the movable portion of the projecting counter-form, the upper die comprising an inner side half-die that has a planar bottom surface parallel to the mounting surface and an inner imprint side surface intended to delimit a sidewall of the corrugation situated on the inside of the bend, the inner imprint side surface having a longitudinal axis parallel to the planar mounting surface, and an outer side half-die that has a planar bottom surface parallel to the mounting surface and an outer imprint side surface intended to delimit a sidewall of the corrugation situated on the outside of the bend, the outer imprint side surface having a longitudinal axis parallel to the longitudinal axis of the inner imprint side surface, the hollow upper die being oriented relative to the bottom frame such that the longitudinal axis of the inner and outer imprint side surfaces forms a bending angle with respect to the stationary portion of the projecting counter-form and, during the lowering movement of the top frame:

bringing the outer imprint side surface, initially via the bottom edge of same, into contact with the top of an outer sidewall of the corrugation, sliding the outer imprint side surface downwards against the outer sidewall of the corrugation, so as to push the outer sidewall of the corrugation in the bending direction, turn the movable portion towards an end position aligned with the longitudinal axis of the outer imprint side surface, and thus push the inner sidewall of the corrugation in the bending direction, wherein the corrugation is deformed by a sliding contact against the movable portion, such that the sheet metal plate is unwound behind the outer sidewall and wound up in front of the inner sidewall of the movable portion.

According to one embodiment, the planar portions of the sheet metal plate are clamped against the mounting surface by means of sidewall clamps.

According to one embodiment, the invention provides a sheet metal forming device intended to form a bend in a corrugation, the forming device comprising:

a bottom frame having a planar mounting surface intended to receive a sheet metal plate having a corrugation that needs to be bent, the corrugation that needs to be bent projecting relative to a planar portion of the sheet metal plate, a projecting counter-form arranged on the mounting surface and intended to be accommodated in the corrugation that needs to be bent, the projecting counter-form having a stationary portion and a movable portion that is hinged, relative to the stationary portion, about an axis perpendicular to the mounting surface, a top frame arranged above the bottom frame, a press configured to lower the top frame towards the bottom frame, and a hollow upper die carried by the top frame between the top frame and the bottom frame, the hollow upper die being arranged above the movable portion of the projecting counter-form, the upper die comprising:

an inner side half-die that has a planar bottom surface parallel to the mounting surface and an inner imprint side surface intended to delimit a sidewall of the corrugation situated on the inside of the bend, the inner imprint side surface having a longitudinal axis parallel to the planar mounting surface, and an outer side half-die that has a planar bottom surface parallel to the mounting surface and an outer imprint side surface intended to delimit a sidewall of the corrugation situated on the outside of the bend, the outer imprint side surface having a longitudinal axis parallel to the longitudinal axis of the inner imprint side surface, the hollow upper die being oriented or orientable relative to the bottom frame such that the longitudinal axes of the inner and outer imprint side surfaces form a bending angle with respect to the stationary portion of the projecting counter-form, and the hollow upper die, in particular the outer side half-die of the hollow upper die, being coupled to the top frame in order to transmit the force of the press towards the bottom frame.

As a result of these features, when the top frame is lowered towards the bottom frame under the effect of the press, from an initial state in which a sheet metal plate is positioned on the planar mounting surface and the projecting counter-form is accommodated in the corrugation that needs to be bent, the movable portion of the projecting counter-form has an initial position, and the hollow upper die is oriented relative to the top frame such that the longitudinal axis of the imprint side surfaces forms a bending angle with respect to the movable portion of the projecting counter-form in the initial position, the following operation can be obtained:

a bottom edge of the outer side half-die comes into contact with a crest portion of the corrugation that needs to be bent and the imprint side surface of the outer side half-die slides against an outer sidewall of the corrugation that needs to be bent so as to press the outer sidewall of the corrugation that needs to be bent against the outer sidewall of the movable portion, from the crest to the trough of the corrugation, so as to shape the outer sidewall of the corrugation that needs to be bent to the outer sidewall of the movable portion, and simultaneously turn the movable portion from the initial position to an end position aligned with the imprint side surfaces of the two half-dies of the hollow upper die, such that, in an end state, a longitudinal portion of the corrugation that needs to be bent is sandwiched between the movable portion of the projecting counter-form and the hollow upper die and is bent by an angle equal to said bending angle with respect to the initial state.

According to advantageous embodiments, such a device can have one or more of the following features:

In one embodiment, the inner side half-die is mounted to as to be able to slide relative to the top frame, such that it can slide along an axis parallel to the actuation direction of the press between a deployed position in which the inner side half-die is offset towards the mounting surface relative to the outer side half-die and a retracted position in which the inner side half-die is aligned with the outer side half-die, the inner side half-die being capable of sliding from the deployed position to the retracted position in contact with the bottom frame as the top frame lowers towards the bottom frame under the effect of the press.

In this embodiment, the inner side half-die can initially be positioned in the deployed position. In this case, the inner side half-die in the deployed position comes into contact first with the sheet metal plate at a distance from an inner blank of the corrugation that needs to be bent, and the inner side half-die then slides towards the retracted position as the top frame lowers towards the bottom frame.

In one embodiment, the device further comprises two sidewall clamps carried by the top frame to either side of the hollow upper die and arranged between the top frame and the bottom frame, each sidewall clamp being mounted so as to be able to slide on the top frame along an axis parallel to the actuation direction of the press, each sidewall clamp comprising a planar bottom surface parallel to the mounting surface of the bottom frame, the device further comprising return springs interposed between the top frame and the sidewall clamps in order to elastically return the sidewall clamps to a deployed position towards the bottom frame.

As a result of these features, the planar portions of the metal sheet can be held in a planar state between the mounting surface and the bottom surface of the sidewall clamps during the forming of the bent corrugation.

In one embodiment, a first of the sidewall clamps, which is adjacent to the inner side half-die, engages with the inner side half-die in order to keep the bottom surface of the inner side half-die aligned with the bottom surface of the first sidewall clamp and elastically return the inner side half-die to the deployed position of the inner side half-die under the effect of the return springs.

Alternatively, or in combination, a spring can be arranged directly between the top frame and the inner side half-die in order to elastically return the inner side half-die towards the deployed position.

Different technologies may be used to produce the return springs. In one embodiment, the return springs are gas lift cylinders. Particular advantages of gas lift cylinders are their high power, small space requirement, simplicity of use and relatively low cost In one embodiment, the device further comprises a guide block arranged between the top frame and the bottom frame and mounted pivoting on the top frame about an axis perpendicular to the mounting surface, the hollow upper die being mounted on the guide block such that the bending angle can be adjusted by pivoting the guide block relative to the top frame.

Therefore, the value of the bending angle can be chosen by pivoting the guide block. In one embodiment, the device further comprises a dial graduated with angular measurement units carried by one of the guide block and the top frame in order to visually indicate the value of the bending angle.

In one embodiment, a pivoting range of the guide block encompasses bending angles situated to either side of a neutral orientation aligned with the stationary portion of the counter-form, and each of the two half-dies is able to slide relative to the guide block, so as to be able to slide between a deployed position and a retracted position along an axis parallel to the actuation direction of the press, each of the two half-dies being able to act as the inner side half-die depending on the direction of the bending angle with respect to the neutral orientation.

Therefore, the device can be used to bend the corrugation to the right or to the left, depending on how the guide block is adjusted relative to the neutral orientation.

In one embodiment, the guide block further comprises removable fasteners for selectively holding each of the two half-dies in the retracted position. Therefore, the outer side half-die can be held in the retracted position during the forming of the bent corrugation. Different techniques can be used for producing such removable fasteners, which may, for example, be in the form of elastic push-buttons, cotter pins, racks, ratchets, screws, etc.

In one embodiment, each of the two sidewall clamps is arranged in such a way as to engage with the half-die adjacent to said sidewall clamp when, depending on the orientation of the guide block, the half-die adjacent to said sidewall clamp is the inner side half-die, such that, for both directions of the bending angle relative to the neutral orientation, the bottom surface of the inner side half-die is kept aligned with the bottom surface of the adjacent sidewall clamp and the inner side half-die is elastically returned to the deployed position under the effect of the return springs.

Therefore, the device can operate in a similar manner to bend the corrugation to the right or to the left, which makes it easier to use.

In one embodiment, the device further comprises a link bar extending transverse to and above the stationary portion of the counter-form and linking the two sidewall clamps rigidly together. This helps optimize the stability of the sidewall clamps. Preferably, the two sidewall clamps and the link bar are produced as a single part.

Several features described below can be used in order to preserve the cross-sectional profile of the corrugation during the forming of the bent corrugation.

In one embodiment, the movable portion of the counter-form has a cross-sectional shape that matches a cross-sectional profile of the corrugation that needs to be bent, the inner imprint side surface having a profile that matches a first cross-sectional half-profile of the corrugation that needs to be bent and the outer imprint side surface having a profile that matches a second cross-sectional half-profile of the corrugation that needs to be bent.

In one embodiment, the device further comprises a shaft mounted pivoting in the bottom frame about an axis perpendicular to the planar mounting surface of the bottom frame, the shaft having a circular end surface aligned with the planar mounting surface, the movable portion of the counter-form having a first length portion attached to the end surface of the shaft along a radius of the circular end surface and a second length portion extending on the planar mounting surface in the continuation of the first length portion and in sliding contact with the planar mounting surface, the stationary portion of the counter-form being oriented in a direction intersecting with the center of the end surface, the stationary portion of the counter-form having a first length portion attached to the planar mounting surface and a second length portion extending on the end surface of the shaft in the continuation of the first length portion and in sliding contact with the end surface.

In one embodiment, the first length portion of the movable portion of the counter-form and the second length portion of the stationary portion of the counter form each extend towards the center of the end surface without reaching the center of the end surface, the end surface further carrying a central corrugation plate arranged between the movable portion and the stationary portion of the counter-form, the central corrugation plate being mounted pivoting on the end surface coaxially with the shaft, the dimensions of the cross section of the central corrugation plate being slightly smaller than the cross section of the movable portion of the counter-form.

In one embodiment, the device further comprises a floating corrugation plate that has the same cross-sectional shape as the central corrugation plate and is arranged between the central corrugation plate and one of the movable portion and the stationary portion of the counter-form, the floating corrugation plate being linked to said one of the movable portion and the stationary portion with a degree of translational freedom along the axis of said one of the movable portion and the stationary portion and with a degree of freedom to pivot about an axis perpendicular to the mounting surface.

In one embodiment, the projecting counter-form further has a third portion that is hinged, relative to the movable portion, about a second axis perpendicular to the mounting surface, the device further comprising a second top frame arranged above the bottom frame and intended to be actuated towards the bottom frame by a press, a second hollow upper die carried by the second top frame between the second top frame and the bottom frame, the second hollow upper die being arranged above the third portion of the projecting counter-form.

In this case, the first top frame and the second top frame of the forming device can be arranged under the press so as to be lowered simultaneously towards the bottom frame in order to produce two bends with a single stroke of the press.

The invention also provides a used of the abovementioned forming device, in which:

in an initial state, a sheet metal plate is positioned on the planar mounting surface and the projecting counter-form is accommodated in the corrugation that needs to be bent, the movable portion of the projecting counter-form has an initial position, and the hollow upper die is oriented relative to the top frame such that the longitudinal axis of the imprint side surfaces forms a bending angle with respect to the movable portion of the projecting counter-form in the initial position, then, when the top frame is lowered towards the bottom frame under the effect of the press:

as required, the inner side half-die in the deployed position comes into contact first with the sheet metal plate at a distance from an inner blank of the corrugation that needs to be bent, and the inner side half-die then slides towards the retracted position as the top frame lowers towards the bottom frame, a bottom edge of the outer side half-die comes into contact with a crest portion of the corrugation that needs to be bent and the imprint side surface of the outer side half-die slides against an outer sidewall of the corrugation that needs to be bent so as to press the outer sidewall of the corrugation that needs to be bent against the outer sidewall of the movable portion, from the crest to the trough of the corrugation, so as to shape the outer sidewall of the corrugation that needs to be bent to the outer sidewall of the movable portion, and simultaneously turn the movable portion from the initial position to an end position aligned with the imprint side surfaces of the two half-dies of the hollow upper die, in an end state, a longitudinal portion of the corrugation that needs to be bent is sandwiched between the movable portion of the projecting counter-form and the hollow upper die and is bent by an angle equal to said bending angle with respect to the initial state.

In one embodiment, the initial position of the movable portion of the projecting counter-form is aligned with the stationary portion, the corrugation that needs to be bent having a straight shape in the initial state.

In one embodiment, the initial position of the movable portion of the projecting counter-form is turned by an initial angle relative to the stationary portion, the corrugation that needs to be bent having a shape bent by the initial angle in the initial state and a shape bent by an angle equal to the sum of the initial angle and the bending angle in the end state.

Such a device can therefore also be used to bend a corrugation in a plurality of successive passes, with a bending angle that is increased at each pass.

BRIEF DESCRIPTION OF THE FIGURES

The invention will be more clearly understood, and other aims, details, features and advantages of same will become clearer on reading the following description of several specific embodiments of the invention, provided as purely illustrative and non-limiting examples, with reference to the appended drawings.

DETAILED DESCRIPTION OF EMBODIMENTS

A sheet metal forming device intended to form a bend in a corrugation of a metal sheet is described below. The corrugation or corrugations in the metal sheet need to be formed before using this forming device, which is intended to bend a pre-existing corrugation. The pre-existing corrugation can be obtained by known folding methods, in particular according to a rectilinear geometry.

Figure 1:
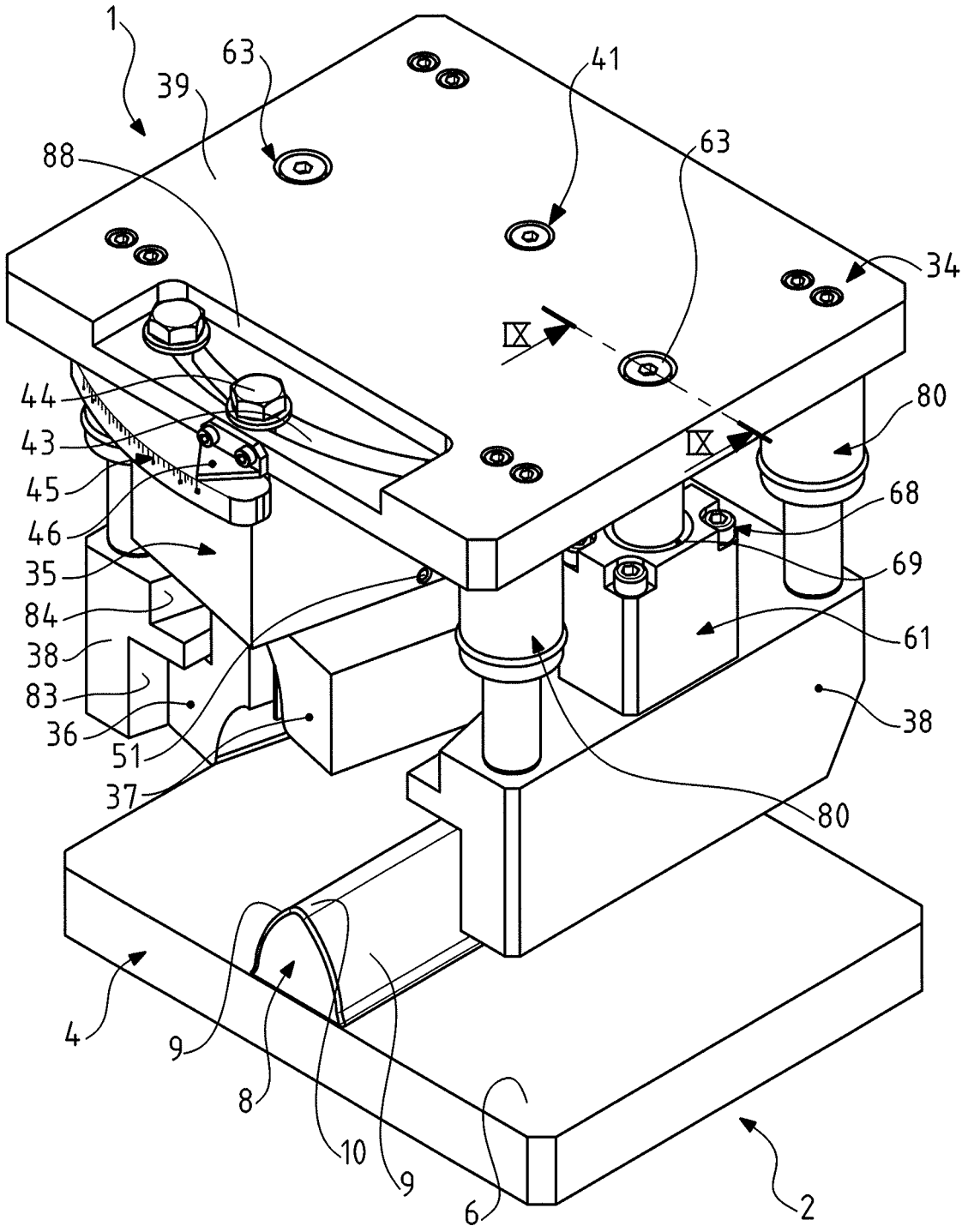
FIG. 1 is a general perspective view of a forming device according to one embodiment of the invention, in an open position.
Figure 6:
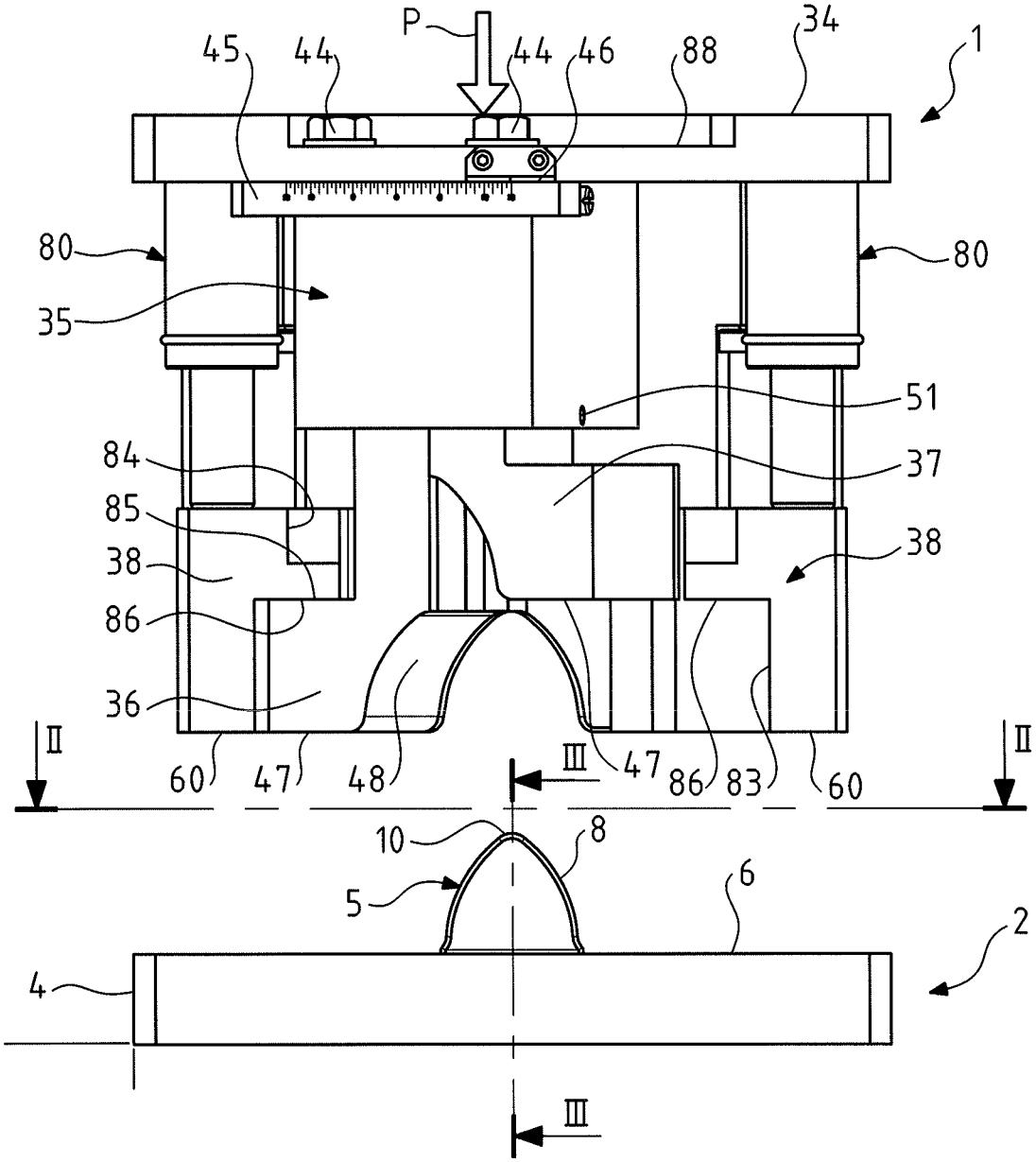
FIG. 6 is a front view of the device of FIG. 1.
Figure 12:
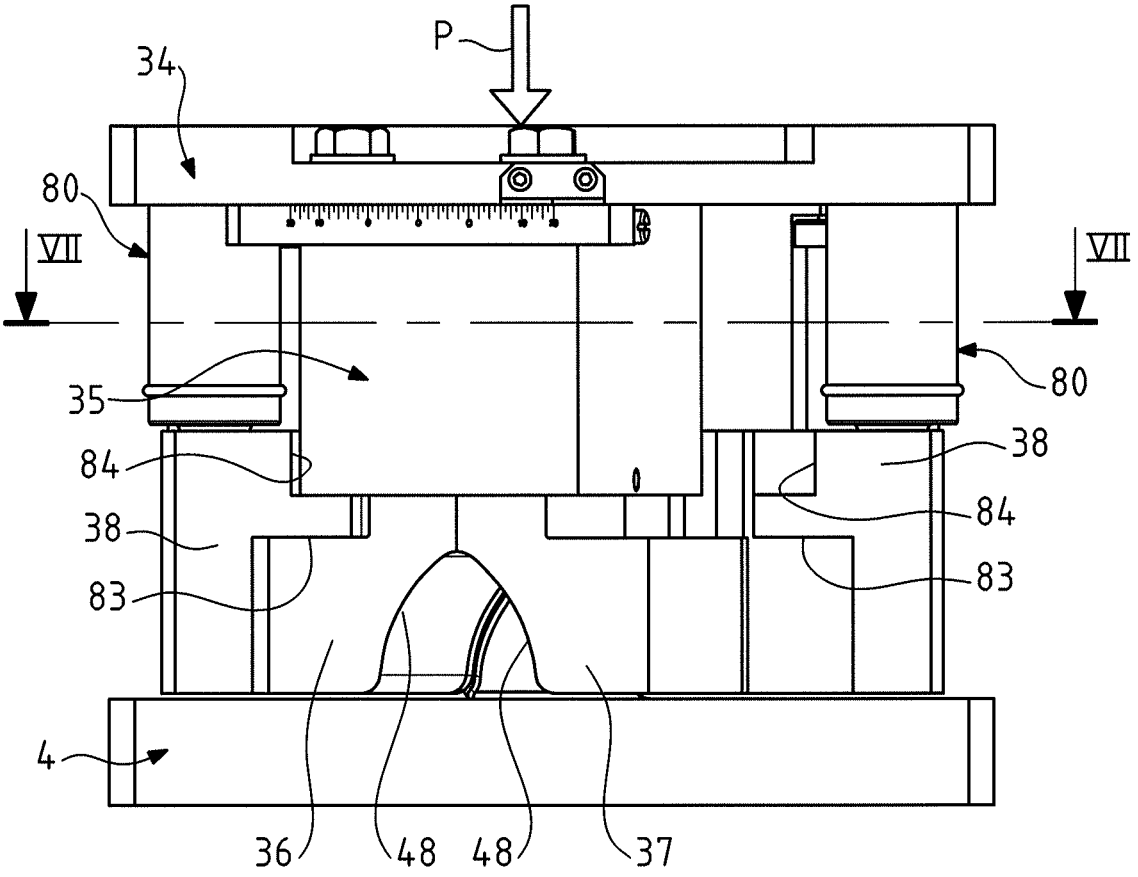
FIG. 12 is a front view of the device of FIG. 1 in a closed state, corresponding to a subsequent step in which the press is actuated.

FIGS. 1 and 6 provide an overall view of the forming device, which consists of a top part 1 and a bottom part 2, which are shown in the open position of the device and are intended to be actuated towards each other by means of a press, which is not shown here, for example a hydraulically actuated press, in the direction indicated by the arrow P in FIGS. 6 and 12. The direction indicated by the arrow P shall be referred to as the vertical direction, by convention, regardless of the actual orientation of same in the gravitational field. The press which is not shown here actuates the forming device from the open position of FIGS. 1 and 6 to the closed position of FIG. 12, and vice versa.

The power required by the press in order to perform this actuation depends on the nature and the thickness of the metal sheet that needs to be worked. For a stainless-steel metal sheet 1.2 mm thick, a 10-ton bending press can be used.

Figure 2:
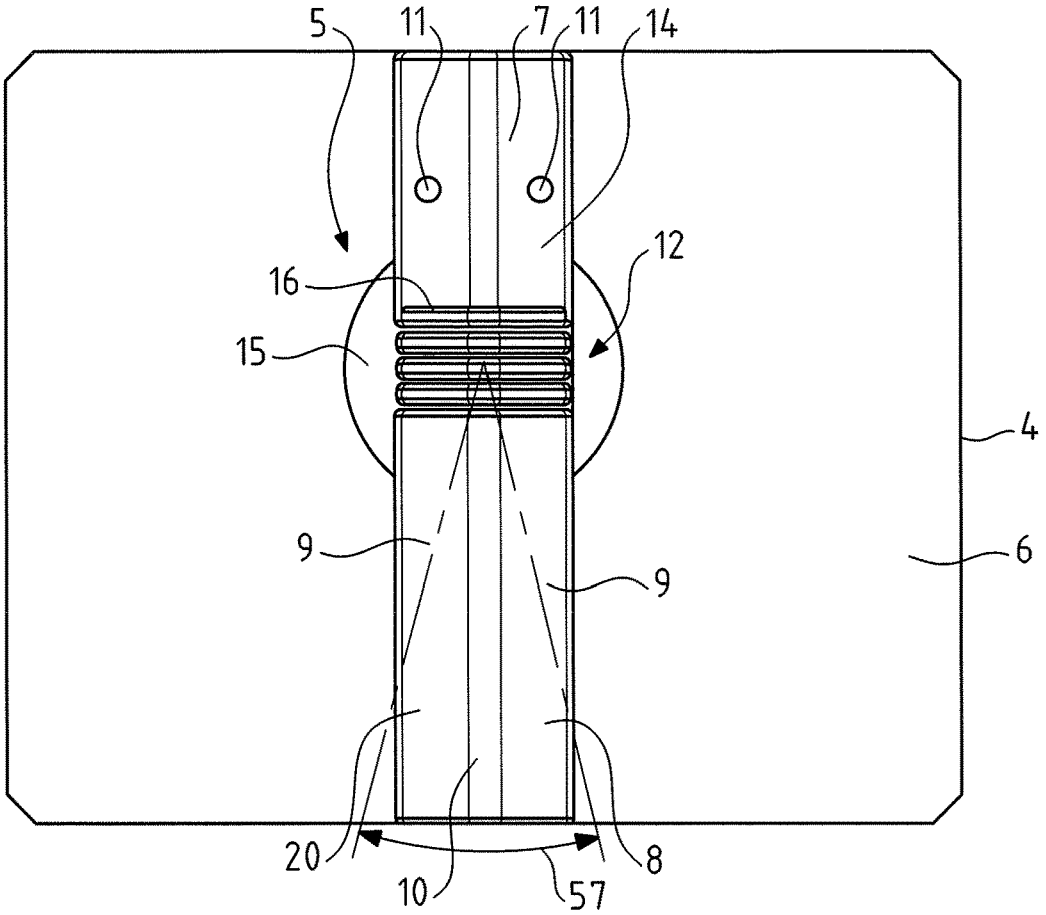
FIG. 2 is a top view of the bottom part of the device of FIG. 1, along the axis II-II of FIG. 6.
Figure 3:
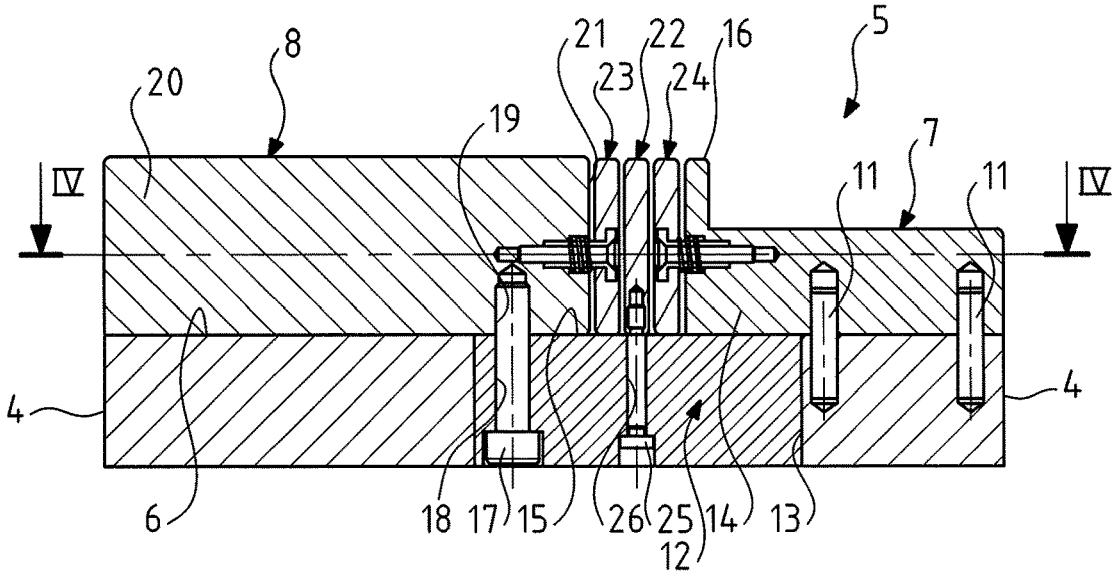
FIG. 3 is a cross-sectional view of the bottom part of the device of FIG. 1, along the axis III-III of FIG. 6.

In reference to FIGS. 2 and 3, the bottom part 2, which essentially consists of a bottom frame 4 and a counter-form 5 that is hinged, will now be described in greater detail.

The bottom frame 4 is a thick, planar plate that has a planar top surface 6 intended to receive the metal sheet that needs to be worked, in particular the planar parts of same. The metal sheet that needs to be worked is shown as reference number 70 in FIGS. 10, 11 and 13.

The counter-form 5 is mounted projecting out of the planar top surface 6 and mainly comprises a straight stationary portion 7 and a movable portion 8 that is also straight. The cross-sectional shape of the movable portion 8 is substantially identical to the inner profile of the corrugation that needs to be bent, i.e. in this case with two semi-elliptical sides 9 that are symmetrical with respect to the vertical plane III-III in FIG. 6, and a crest area 10 where the curvature is more pronounced. Therefore, the movable portion 8 occupies substantially all of the inner space of the corrugation in which it is engaged.

The bottom part of the stationary portion 7 is the same width, but said portion is smaller in height, and therefore does not occupy all of the inner space of the corrugation in which it is engaged. However, given that the length portion of the corrugation that receives the stationary portion 7 is not greatly stressed during the actuation of the press, the cross-sectional shape of the stationary portion 7 is not critical, and can be designed in different ways. The stationary portion 7 is attached to the planar top surface 6 by means of screws, that are not shown here, and pins 11 engaged in bores of the stationary portion 7 and the underlying bottom frame 4.

The movable portion 8 is mounted on a shaft 12 in the form of a disk that is accommodated, pivoting, in a cylindrical bearing 13 bored in the center of the bottom frame 4. A length portion 14 of the stationary portion 7 extends in cantilever fashion over the end surface 15 of the shaft 12 and is in sliding contact with same. The cross-sectional shape of the end 16 of the length portion 14 is substantially identical to the movable portion 8.

The movable portion 8 is attached to the end surface 15 of the shaft 12 at a position substantially opposite the end 16 of the stationary portion 7, by means of a pair of large-head screws 17 engaged vertically in a pair of bores 18 in the shaft 12 and screwed into a pair of tapped holes 19 in the movable portion 8. A large length portion 20 of the movable portion 8 extends in cantilever fashion over the planar mounting surface 6 and is in sliding contact with same, such that the movable portion 8 can pivot, about a vertical axis, over a certain angular range to either side of the neutral position shown in FIG. 2. This angular range covers at least the pivoting range of the guide block 35 that is described below, i.e. for example, the range [−13°, +13°] shown by the arrow 57.

Between the end 16 of the stationary portion 7 and the adjacent end 21 of the movable portion 8, the counter-form 5 further comprises three corrugation plates 22, 23 and 24 that have virtually the same cross-sectional shape as the movable portion 8. More specifically, as shown more clearly in FIG. 4, the dimensions of the cross-sectional shape of the three corrugation plates 22, 23 and 24 are slightly smaller than the cross section of the movable portion 8, and therefore than the inner profile of the corrugation, in order to allow the metal sheet to fold in the bending area, rather than resulting in drawing/stretching that would reduce the thickness of the metal sheet. The dimensional difference between the cross section of the three corrugation plates 22, 23 and 24 and the inner profile of the corrugation is of the same order of magnitude as the thickness of the metal sheet, when the angle is less than 15°. It may be necessary to increase this dimensional difference in order to form a larger bending angle.

The central corrugation plate 22 is mounted pivoting on the end surface 15 by means of a washer head screw 25 engaged vertically in a bore 26 in the shaft 12 and thus forming a pivot axis that is vertical with respect to the shaft 12.

Figure 4:
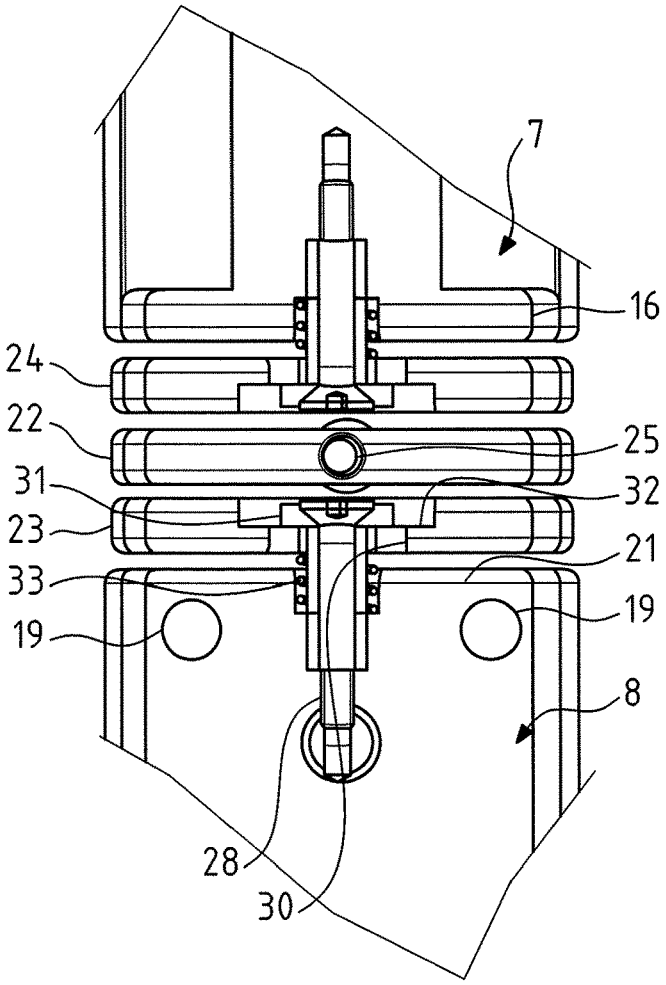
FIG. 4 is a partial enlarged cross-sectional view along the axis IV-IV of FIG. 3.
Figure 5:
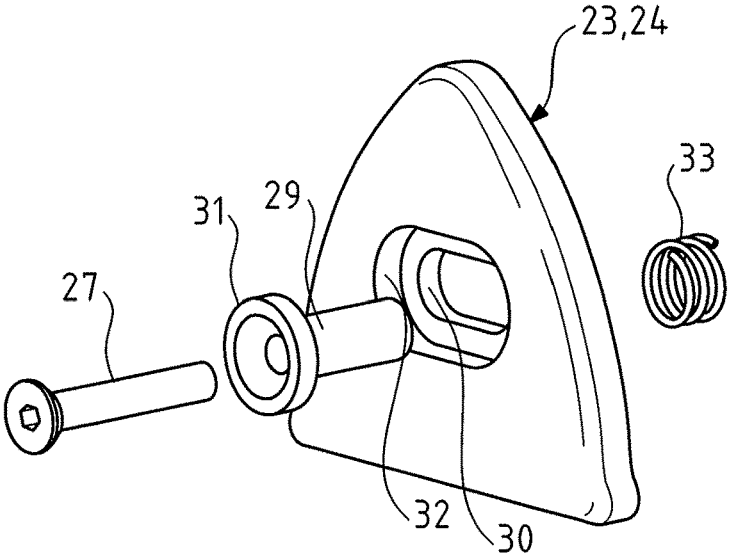
FIG. 5 is an exploded perspective view of a floating corrugation plate of the bottom part of the device of FIG. 1.

The floating corrugation plates 23 and 24 are shown in greater detail in FIGS. 4 and 5. The floating corrugation plate 23 is linked to the end 21 of the movable portion 8 with translational clearance in the length direction of the counter-form, lateral translational clearance, and rotational clearance about a vertical axis. For this purpose, a screw 27 is screwed into a threaded hole 28 provided longitudinally in the end 21. A socket 29 with a large head 31 is engaged in a sliding manner around the screw 27. The socket 29 and the screw 27 that it contains are engaged in an oblong hole 30 of the floating corrugation plate 23. The large head 31 is accommodated in a counterbore 32 of the floating corrugation plate 23. A compression spring 33 is engaged on the socket 29 and bears respectively on a surface of the floating corrugation plate 23 opposite the counterbore 32 and on the end 21 of the movable portion 8. The floating corrugation plate 24 is linked in the same way to the end 16 of the stationary portion 7.

As a result of these clearances, the corrugation plates 22, 23 and 24 help keep the cross-sectional profile of the corrugation that needs to be bent virtually constant during the operation of the forming device, while freely following the deformation of the material in this location, since the corrugation plates 22, 23 and 24 are located specifically in the bend that is ultimately produced in the corrugation.

Returning to FIG. 1, there now follows a description of the top part 1 of the forming device, which consists mainly of a top frame 34, a guide block 35 carrying sliding half-dies 36 and 37, and two sidewall clamps 38 mounted sliding on either side of the guide block 35. The top frame 34 is a thick, planar plate that has a planar top surface 39 intended to receive the pressing force of the press, which is not shown here.

Figure 7:
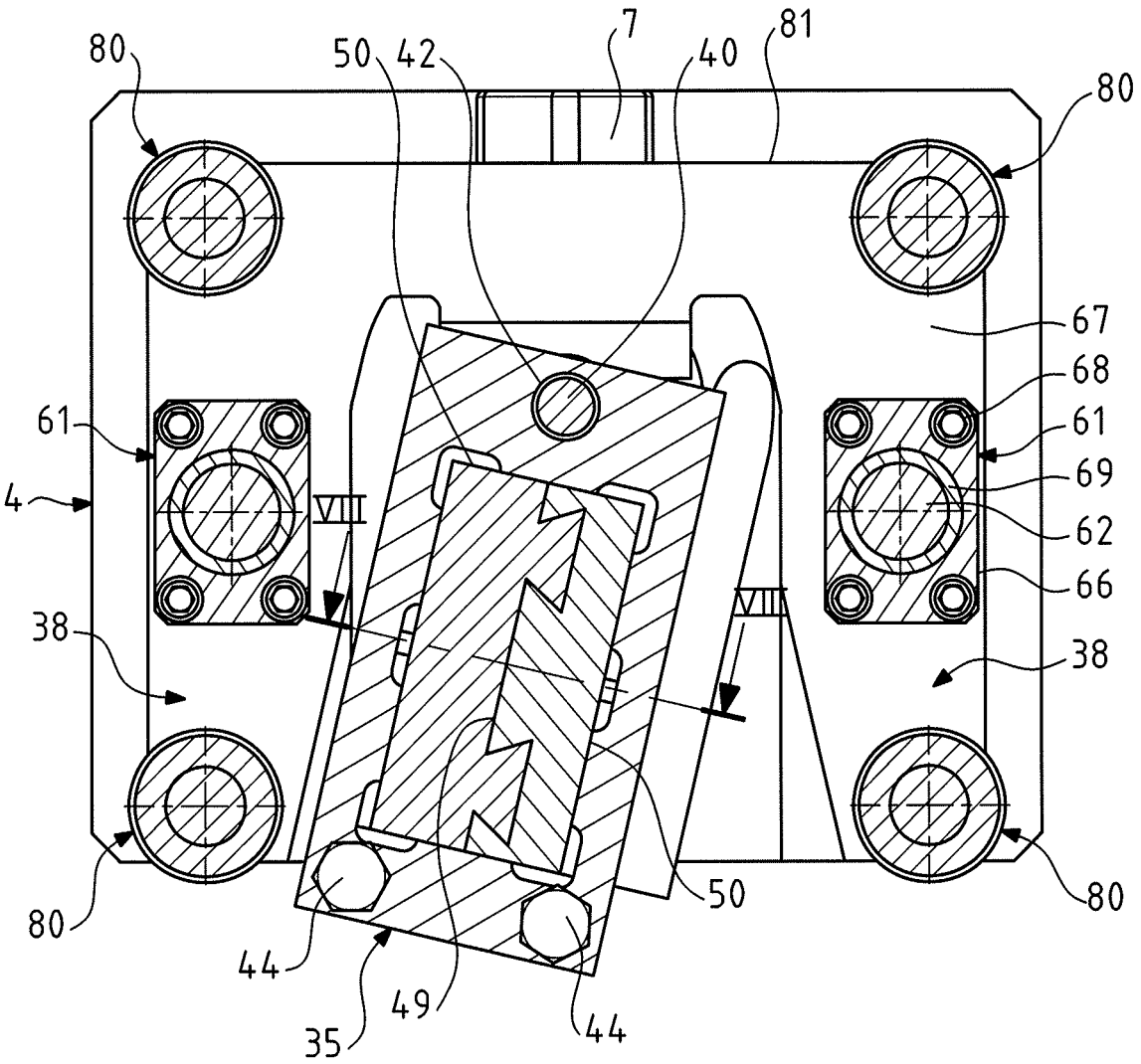
FIG. 7 is a cross-sectional view of the device of FIG. 1 along the axis VII-VII of FIG. 12.

In reference to FIGS. 1 and 7, the guide block 35 is a parallelepiped sleeve mounted pivoting under the top frame 34 by means of a stepped pin 40 oriented perpendicular to the top frame 34 and a screw 41 attaching the stepped pin 40 to the top frame 34. Self-lubricating bronze bushings 42 are arranged in the bore receiving the stepped pin 40, which is provided in a rear wall of the guide block 35.

The value of the working angle of the forming device can be adjusted by pivoting the guide block 35. For this purpose, a groove 43 in the shape of an arc concentric to the stepped pin 40 is bored into a front part of the top frame 34 and traversed by two screws 44 holding a front wall of the guide block 35 to the top frame 34. In order to adjust the angle, the screws 44 can be loosened in order to be able to slide along the groove 43, then retightened in the desired angular position. Indeed, the guide block 35 must be locked firmly in position during the closing movement of the press. As seen in FIG. 1, the guide block 35 is shown here in the position turned as far as possible in a positive direction, i.e. for example +13° with respect to the neutral position aligned with the stationary portion 7. The heads of the two screws 44 are accommodated in a counterbore 88 of the top frame 34.

A dial 45 with angle markers is attached to a front face of the guide block 35 and an angular positioning cursor 46 is attached to a front face of the top frame 34 to indicate the working angle. The dial and the angular positioning cursor can also be switches around.

Figure 8:
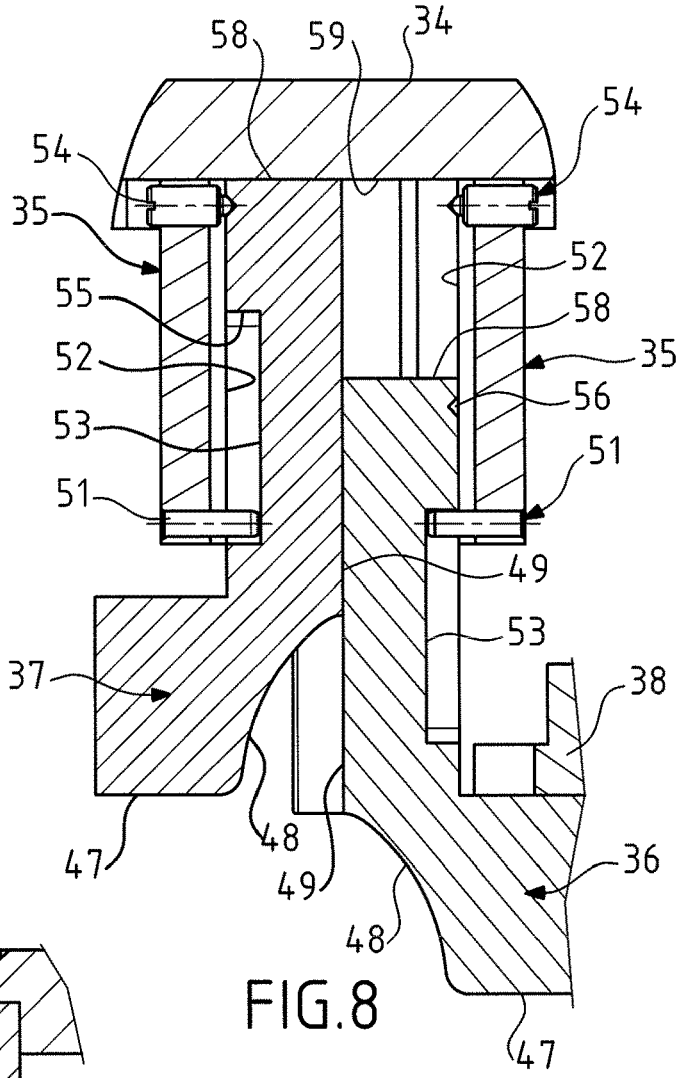
FIG. 8 is a cross-sectional view of the guide block along the axis VIII-VIII of FIG. 7, the device, however, being in the open position of FIG. 1.

In reference to FIGS. 7 and 8, the two half-dies 36 and 37 that form the hollow upper die are mounted so as to be able to slide in the guide block 35. The half-dies 36 and 37 are relatively flat parts that extend in the length direction of the guide block 35 above the movable portion 8 of the counter-form 5. Each half-die 36, 37 comprises a planar bottom surface 47 and an imprint side surface 48 that matches the outer profile of the corrugation that needs to be bent and that extends between the planar bottom surface 47 and the vertical contact surface 49 of the two half-dies 36 and 37.

The half-dies 36 and 37 are mounted so as to be able to slide perpendicular to the top frame 34 relative to the guide block 35 and relative to each other, so as to be able to slide independently of each other. Three dovetail slides are produced in the vertical contact surface 49 of the two half-dies 36 and 37 in order to ensure the mutual positioning of same is highly accurate during all of the respective sliding movements of same. Concerning the link with the guide block 35, the peripheral vertical surfaces 50 of the two half-dies 36 and 37 are in sliding contact with the corresponding inner surfaces 52 of the guide block 35. Moreover, a pin 51 is in each instance engaged in a vertical groove 53 of the half-die 36, 37 through a bore in the guide block 35 so as to abut against an end surface 55 of the groove 53 in the maximum deployed position of the half-die, as shown in FIG. 8 for the half-die 36.

A spring-loaded pusher 54 is in each instance mounted in the guide block 35 in line with each half-die 36, 37 so as to be able to lock the half-die 36, 37 in the retracted position. More specifically, in the retracted position, the spring-loaded pusher 54 snaps resiliently into a notch 56 of the half-die 36, 37, as shown in FIG. 8 for the half-die 37. In the retracted position, a top surface 58 of the half-die 36, 37 abuts against the bottom surface 59 of the top frame 34 in order to transmit the pushing force of the press.

In a manner not shown here, an alternative system to the spring-loaded pusher 54 may be used, for example a system using a cotter pin, screw or rack to control the positioning of the half-dies 36, 37.

For the operation of the forming device, only the outer side half-die needs to slide relative to the top frame 34. The sliding assembly of the two half-dies 36 and 37 makes it possible to use the device described here in order to form bends in both directions. In a simplified device intended for forming bends in a single predefined direction, the inner side half-die can be stationary.

Returning to FIG. 6, there now follows a description of the sidewall clamps 38. The two sidewall clamps 38 are two bars that are symmetrical relative to the vertical plane III-III in FIG. 6 that extend parallel to the stationary portion 7 of the counter-form 5 to either side of the counter-form 5. Each sidewall clamp 38 has a generally rectangular planar bottom surface 60 intended to press the planar portions of the metal sheet against the planar mounting surface 6 in order to keep these portions planar during the actuation of the press.

For this purpose, the sidewall clamps 38 are mounted on slides 61 that are vertical relative to the top frame 34. The vertical slides 61 are shows in greater detail in FIGS. 7 and 9. A vertical slide 61 comprises a guide column 62 attached to the top frame 34 by a screw 63. The bottom end of the guide column 62 is accommodated in a bore 64 provided in the sidewall clamp 38 and has a shoulder 65 intended to abut against a bushing housing 66 in order to define the maximum deployed position of the sidewall clamp 38. The bushing housing 66 is attached to the top surface 67 of the sidewall clamp by screws 68 and contains self-lubricating bronze bushings 69 arranged around the guide column 62.

Figure 9:
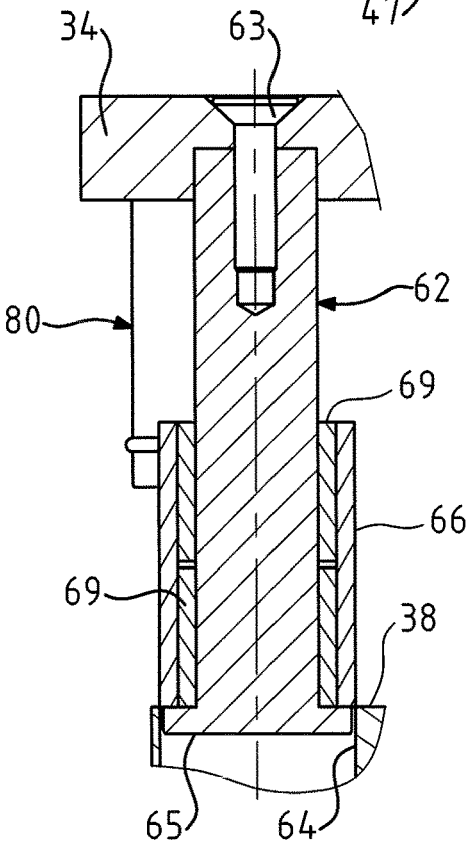
FIG. 9 is a cross-sectional view of a sidewall clamp slide along the axis IX-IX of FIG. 1.

Two return springs, shown here in the form of gas lift cylinders 80, are arranged between each sidewall clamp 38 and the top frame 34, in order to return the sidewall clamp to the deployed position shown in FIGS. 1, 6 and 9.

As shown more clearly in FIGS. 6 and 7, a transverse bar 81 links the rear parts of the two sidewall clamps 38 in order to rigidly connect the two sidewall clamps 38. The two sidewall clamps 38 and the transverse bar 81 can thus be produced as a single U-shaped part. The transverse bar 81 has a cutout 82 so as to span the stationary portion 7 of the counter-form 5 without interfering with it when the forming device is in the closed state (FIG. 12). The cutout 82 has a cross section that matches the outer profile of the corrugation that needs to be bent.

On the side surface facing inwards, the sidewall clamp 38 has two openings, i.e. a bottom opening 83 and a top opening 84, that serve when the sidewall clamp 38 is located at the inner side of the bend. As shown in FIG. 6, the bottom opening 83 can receive a portion of the half-die 36 situated on the inner side in order to engage a top surface 85 of the half-die 36 with a top surface 86 of the bottom opening 83, so as to keep the half-die 36 situated on the inner side in the deployed position, in which the bottom surface 47 is aligned with the bottom surface 60. As shown in FIG. 12, the top opening 84 can receive the base of the guide block 35 in the last part of the movement of the press and in the closed state of the forming device.

There now follows a description of the use of the forming device in reference to FIGS. 10 to 13.

Figure 10:
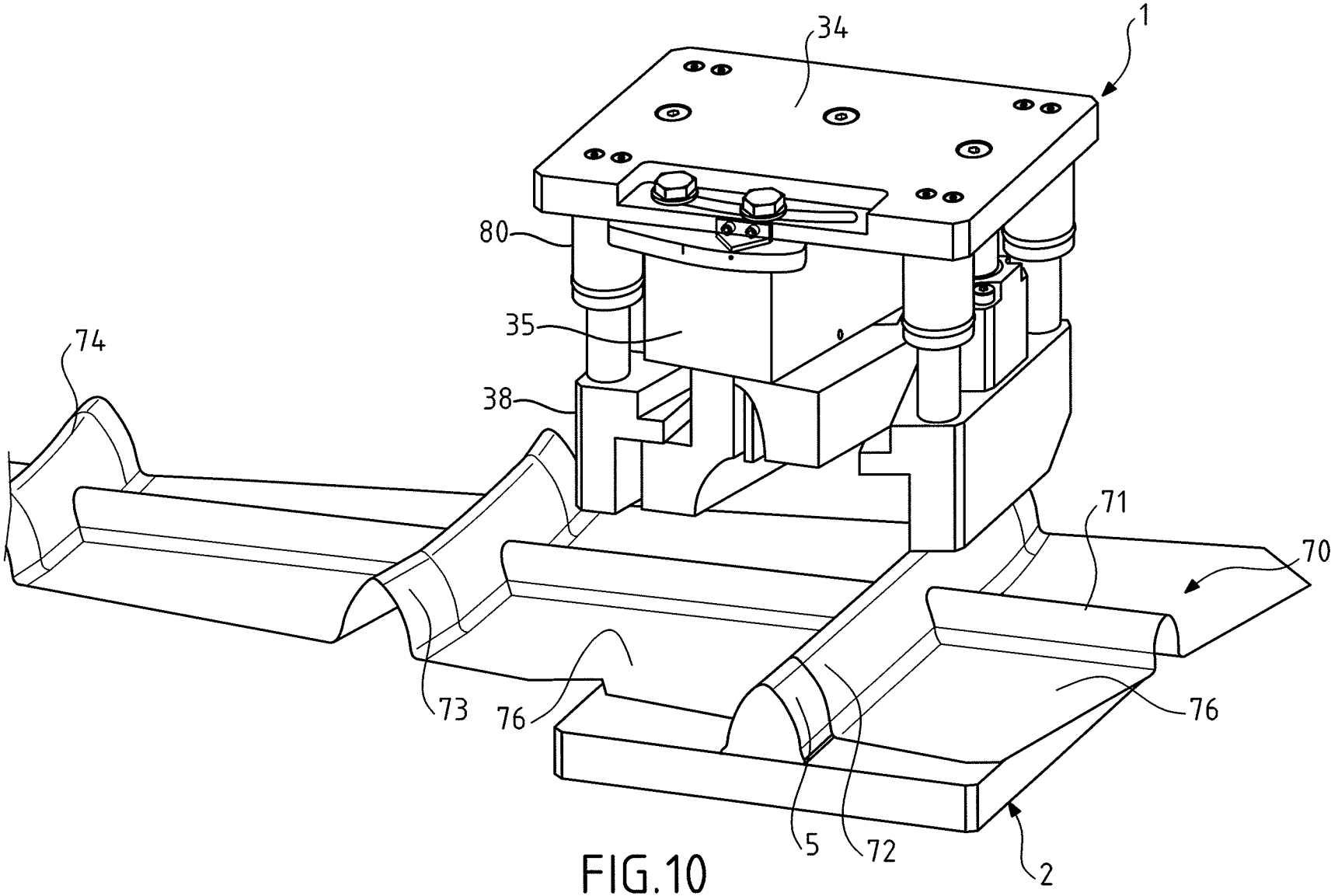
FIG. 10 is a general perspective view of a forming device according to FIG. 1, in the open position, in the presence of a metal sheet having an initially straight corrugation engaged on the counter-form.

In FIG. 10, the forming device is in the open state and a sheet metal plate 70 that needs to be worked is positioned on the bottom part 2. The sheet metal plate 70 is, in this case, a base plate that can be used for producing the sealed membrane of an LNG tank, as taught in WO-A-2011048300. However, this example is not limiting, and the forming device described can be used to work any metal sheet that has at least one corrugation.

Figure 13:
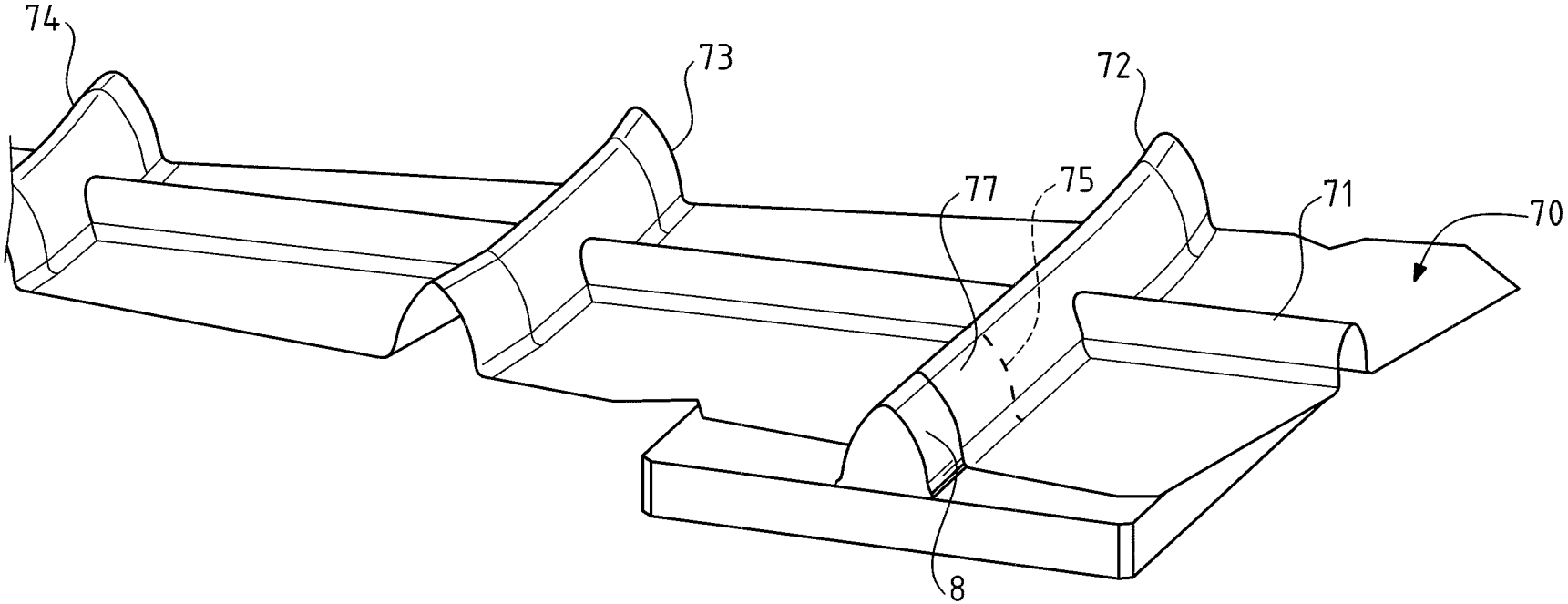
FIG. 13 is a general perspective view of the metal sheet of FIG. 10 ready to be removed from the device following the forming of the bent corrugation.

The sheet metal plate 70 in this example comprises a straight radial corrugation 71 with a smaller height and three circumferential corrugations 72, 73, 74 with a larger height that intersect perpendicularly with the radial corrugation 71, in addition to planar and coplanar portions 76 situated between these corrugations. In FIG. 10, before forming the bend, the circumferential corrugation 72 is straight. In FIG. 13, after the forming operation, the circumferential corrugation 72 has a bend 75 whose angle is equal to the adjustment angle of the guide block 35, for example 13°. A longitudinal portion 77 of the corrugation 72 has turned by this angle relative to the initial state.

Figure 11:
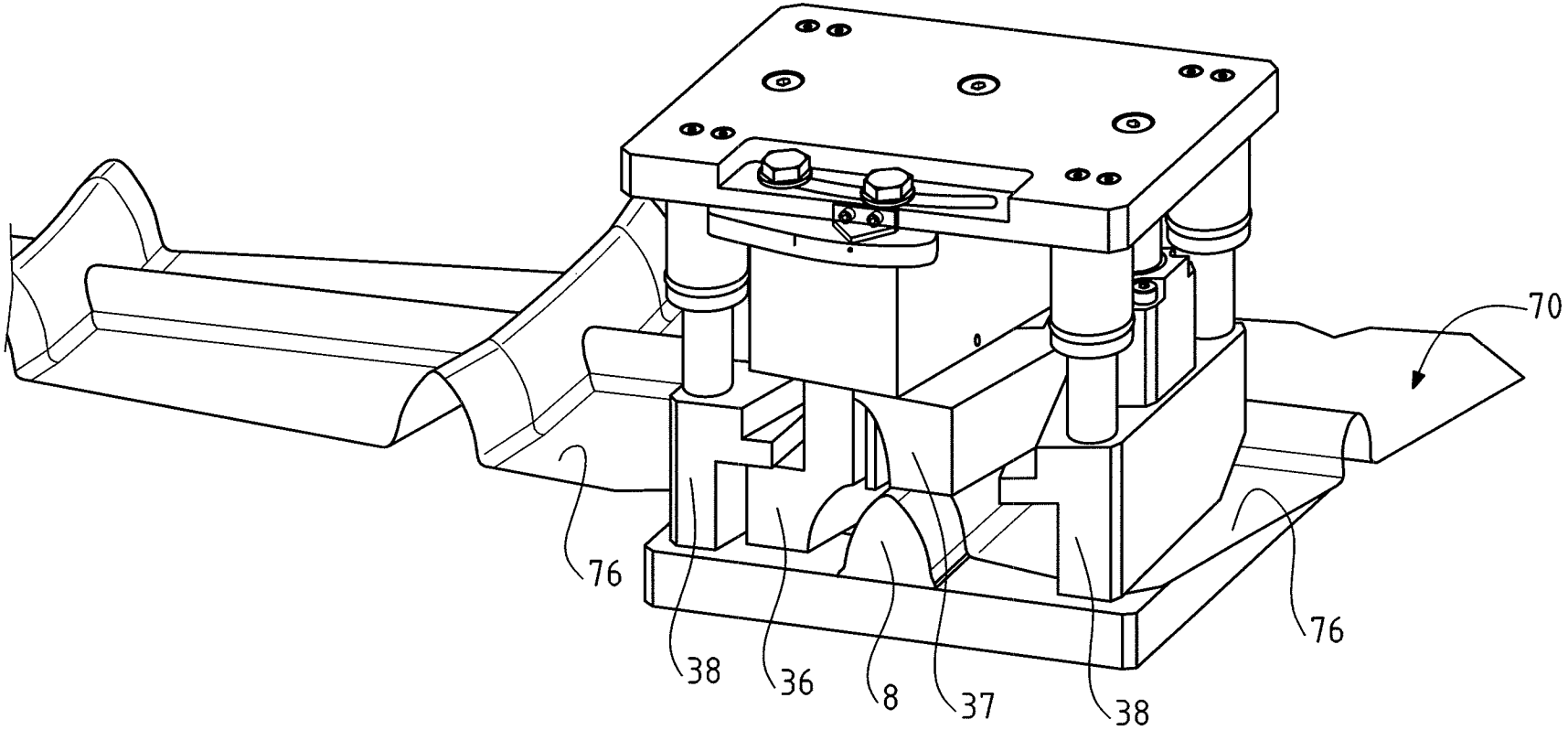
FIG. 11 is a view similar to FIG. 10 in a contact position of the sidewall clamps, corresponding to a subsequent step in which the press is actuated.

Starting from the open state in FIG. 10, the forming device is closed vertically under the effect of the press. In FIG. 11, the closing movement reaches a position in which the sidewall clamps 38 come into contact with the planar portions 76 situated to either side of the circumferential corrugation 72 that needs to be bent. The inner side half-die 36, which is immobilized in the deployed position under the sidewall clamp 38 on the inner side also comes into contact with the sheet metal plate 70, at a distance from the inner sidewall of the corrugation 72. The outer side half-die 37, which is locked in the retracted position, is not yet in contact with the sheet metal plate 70, but is positioned above the crest portion and the outer sidewall of the corrugation 72 and obliquely thereto because of the adjustment angle of the guide block 35.

During the subsequent movement of the press, the top frame 34 is lowered towards the bottom frame 4 by compressing the return springs 80, which allows an increasing clamping force to be applied to the planar portions 76 by means of the sidewall clamps 38. Simultaneously, the imprint side surface 48 of the outer side half-die 37 comes into contact, first via its bottom edge, with the top of the outer sidewall of the corrugation 72. During the final phase of movement of the press, until the closed position in FIG. 12 is reached, the imprint side surface 48 of the outer side half-die 37 slides downwards against the outer sidewall of the corrugation 72 and against the outer sidewall of the movable portion 8. The pressure of the outer side half-die 37 pushes the outer sidewall of the corrugation 72 in the bending direction and turns the movable portion 8 towards the end position aligned with the orientation of the half-dies 36 and 37, which also pushes the inner sidewall of the corrugation 72 in the bending direction. The corrugation 72 is thus deformed by a sliding contact against the movable portion 8, such that the metal sheet is unwound behind the outer sidewall and wound up in front of the inner sidewall without the thickness of the metal sheet being modified and without the adjacent planar portions 76 being affected.

FIG. 12 shows the position of the forming device at the end of the closing movement of the press. The inner side half-die 36 has joined the outer side half-die 37 in the retracted position. The movable portion 8 has reached the orientation in which it is aligned with the half-dies 36 and 37. The press can then raise the top part 1 to open the forming device and remove the sheet metal plate 70, the corrugation 72 of which is now bent, as shown in FIG. 13.

It should be noted that, starting with the bent state shown in FIG. 13, the same operation can be repeated from FIG. 10 by increasing the pivot angle of the guide block 35, so as to gradually form a bend with a more pronounced curve.

It should be noted that several similar forming devices can be mounted on a same press in order to simultaneously work several corrugations of a sheet metal plate.

In a simplified embodiment, the inner side half-die 36 and the outer side half-die 37 can be manufactured as a single-piece component in the form of an integral upper die. In this case, the device operates in the same way, apart from the fact that the inner side half-die 36 remains at the same height as the outer side half-die 37 during the entire movement of the press. In this embodiment, the situation shown in FIG. 11 therefore does not apply, and the inner side half-die 36 will only come into contact with the sheet metal plate 70 at the end of the press movement, in the position shown in FIG. 12. For this reason, the structure of the sidewall clamps 38 also needs to be modified slightly in order not to hinder the lowering movement of the inner side half-die 36.

Moreover, the sidewall clamps 38 and the hollow upper die can be constructed and actuated separately from one another.

Figure 14:
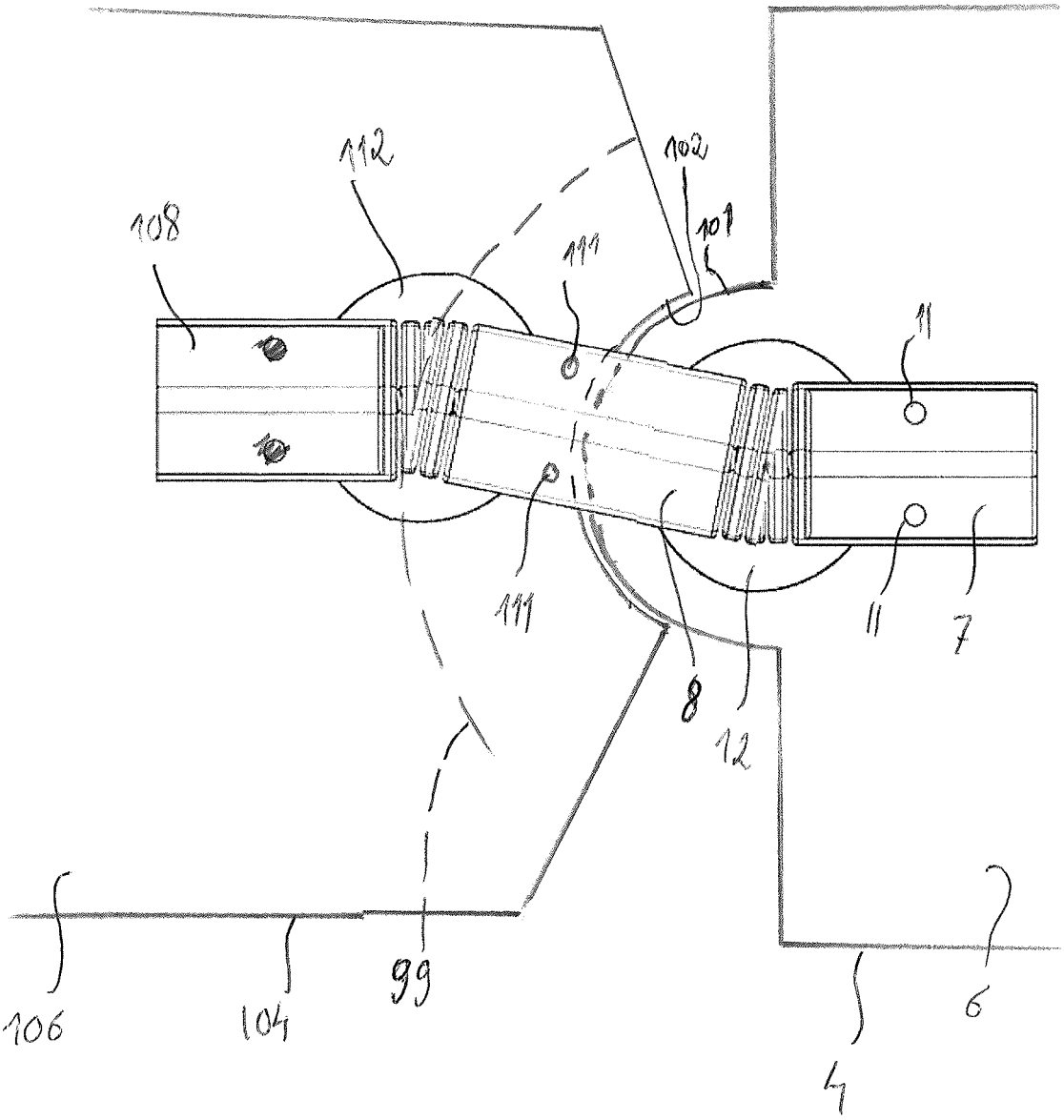
FIG. 14 is a top view of the bottom part of a forming device according to a second embodiment of the invention.
Figure 15:
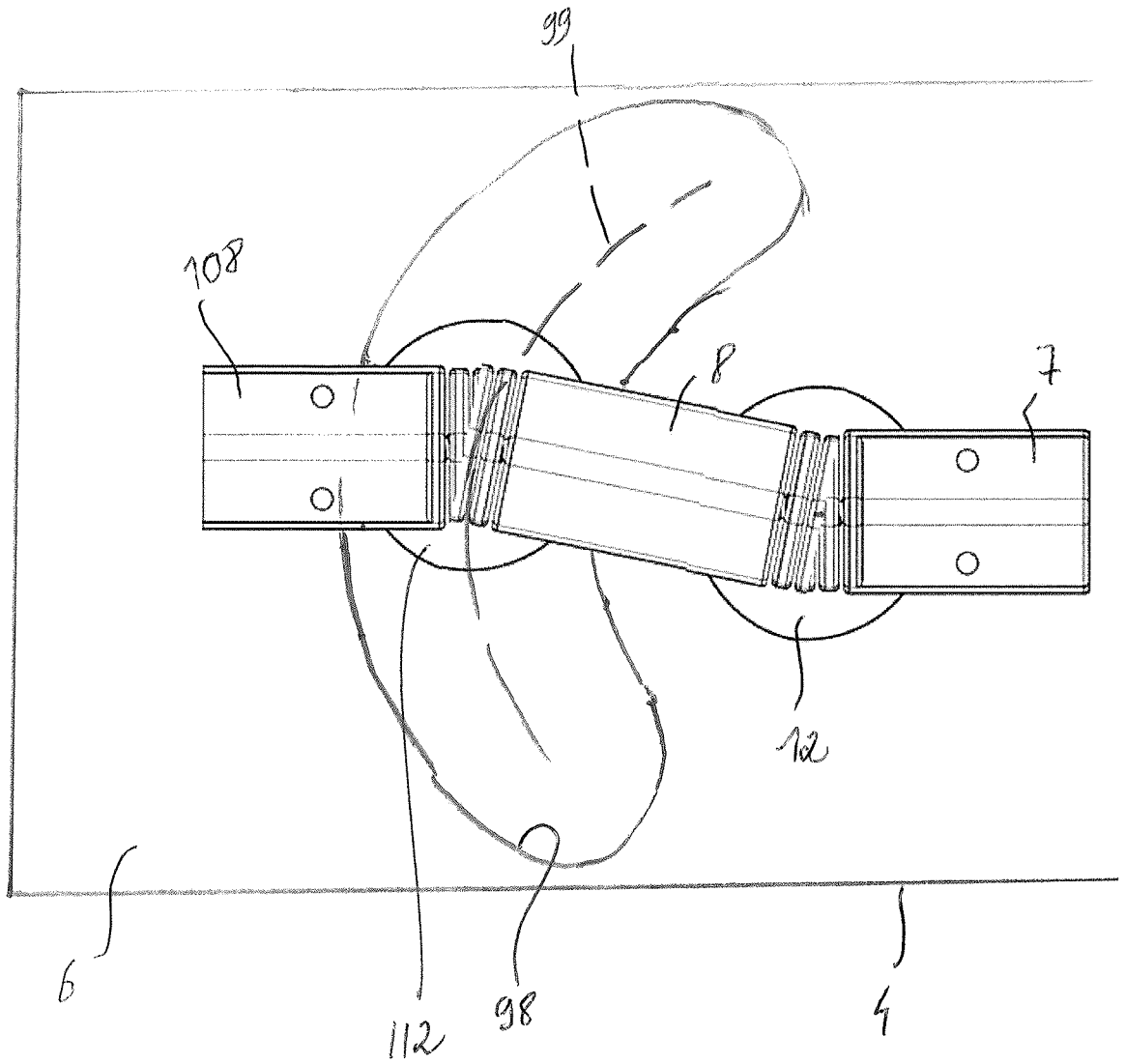
FIG. 15 is a top view of the bottom part of a forming device according to a third embodiment of the invention.

In reference to FIGS. 14 and 15, there now follows a description of the variants of the forming device that allow two bends to be produced successively on a same corrugation.

FIG. 14 is a top view of the bottom part of the forming device according to the second embodiment of the invention. Two bottom frames 4 and 104 having parallel and coplanar top surfaces 6 and 106 are provided in this case.

The bottom frame 104 is hinged to the bottom frame 4 by a pivot link coaxial with the shaft 12 and is secured to the movable portion 8 of the counter-form, for example by pins 111 similar to the pins 11 that have already been described. The pivot link between the bottom frames 4 and 104 can be produced in different ways. In this case, it is formed by two matching cylindrical surfaces 101 and 102 that can slide on one another.

In the same way that the bottom frame 4 carries the shaft 12 in order to hinge the movable portion 8 of the counter-form relative to the stationary portion 7, the bottom frame 104 also carries a shaft 112, that can be produced in the same way as the shaft 12 described above, that provides a second hinge between the movable portion 8 and a third portion 108 of the counter-form. The third portion 108 of the counter-form is thus able to pivot relative to the top frame 104 and produces a second bend in the corrugation.

The top part of the forming device according to the second embodiment, which is not shown here, consists of two instances of the top part 1 described above, i.e. a first top part mounted vertically aligned with the shaft 12 to form the first bend and a second top part mounted vertically aligned with the shaft 112 to form the second bend. In order to be able to adjust to the position of the shaft 112, the second top part is mounted movable along a path 99 in the shape of an arc, for example by means of a carriage suspended from a rail.

The operation of the forming device according to the second embodiment will now be briefly described. In an initial state, the portions 7, 8 and 108 of the counter-form are aligned to receive a metal sheet with a straight corrugation. Using a first press movement actuating the first top part, a bend is formed at the shaft 12, as previously described. During this first press movement, the assembly constituted by the movable portion 8, the bottom frame 104 and the third portion 108 pivot together about the axis formed by the shaft 12. The movable portion 8 and the third portion 108 remain aligned.

Using a second press movement actuating the second top part, a second bend is formed at the shaft 112, in the same way. During this second press movement, the position of the bottom frame 104 relative to the bottom frame 4 should ideally be locked. The first top part of the forming device is held in the lowered position in order to assist this locking, for example.

The direction and the angle of the first bend and the second bend are adjusted separately from each other by, respectively, the orientation of the guide block 35 of the first top part relative to the stationary portion 7 of the counter-form, and the orientation of the guide block 35 of the second top part relative to the movable portion 8 of the counter-form. In particular, the two bends can be in identical or opposing directions and can have the same or different angles. Two bends that are in opposing directions and have the same angle can be used to laterally offset the trajectory of a corrugation without changing the orientation of same.

FIG. 15 is a top view of the bottom part of the forming device according to the third embodiment of the invention. The elements that are similar or identical to those of the second embodiment have been given the same reference number. In this case, the forming device once more has two top parts, that are not shown, in order to produce the two successive bends, but only one bottom frame 4. The shaft 112 that hinges the third portion 108 to the movable portion 8 of the counter-form is mounted movable along a circular path centered on the pivot axis of the shaft 12, for example being accommodated in an oblong groove 98 in the shape of an arc. The shaft 112 is therefore able to move in translation in the groove 98 during the formation of the first bend. Otherwise, operation is identical to the second embodiment.

Figure 16:
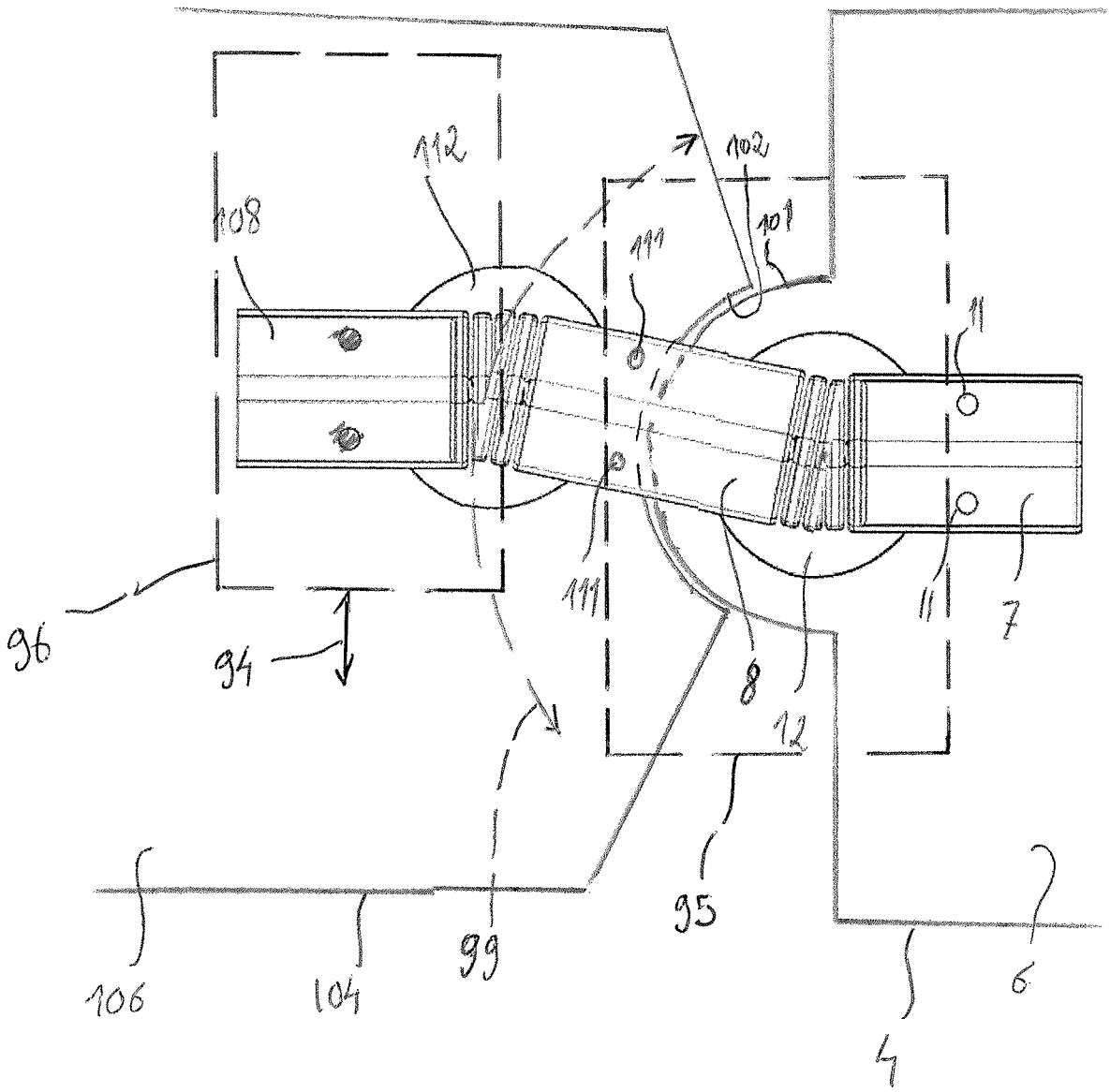
FIG. 16 is a top view of a forming device according to a variant of the second embodiment.

FIG. 16 shows a variant of the forming device according to the second or third embodiment, in which the first top part 95 and the second top part 96 of the forming device are sketched in dashed lines and are intended to produce the two bends with a single stroke of the press. For this purpose, the first top part 95 and the second top part 96 can be mounted under a single press immediately adjacent to each other. The second top part 96 is mounted movable along a path substantially parallel to the arc 99, as shown by the arrow 94, for example by means of a rack, so as to be able to be positioned at the end-of-travel position of the shaft 112.

During operation, the two bends are formed with a single stroke of the press, i.e. the area of the corrugation that covers the movable portion 8 is deflected upwards by the angle imposed by the first top part 95 and the area of the corrugation that covers the third portion 108 is simultaneously straightened back downwards to return to an orientation parallel to the stationary portion 7. FIG. 16 shows the counter-form in the end configuration of the doubly bent corrugation.

The use of the verbs "comprise" or "include" and their conjugated forms does not exclude the presence of elements or steps other than those disclosed in a claim. The use of the indefinite article "a" or "an" for an element or step does not exclude the presence of a plurality of such elements or steps, unless otherwise specified.

The use of reference signs between parentheses in the claims should not be interpreted as a limiting to the claim.

The invention claimed is:

1. A sheet metal forming device configured to form a bend in a corrugation, the forming device comprising:

a bottom frame having a planar mounting surface configured to receive a sheet metal plate having a corrugation that needs to be bent, the corrugation that needs to be bent projecting relative to a planar portion of the sheet metal plate, a projecting counter-form arranged on the mounting surface and configured to be accommodated in the corrugation that needs to be bent, the projecting counter-form having a stationary portion and a movable portion that is hinged, relative to the stationary portion, about an axis perpendicular to the mounting surface, a top frame arranged above the bottom frame, a press configured to lower the top frame towards the bottom frame, and a hollow upper die carried by the top frame between the top frame and the bottom frame, the hollow upper die being arranged above the movable portion of the projecting counter-form, the upper die comprising:

an inner side half-die that has a planar bottom surface parallel to the mounting surface and an inner imprint side surface configured to delimit a sidewall of the corrugation situated on the inside of the bend, the inner imprint side surface having a longitudinal axis parallel to the planar mounting surface, and an outer side half-die that has a planar bottom surface parallel to the mounting surface and an outer imprint side surface configured to delimit a sidewall of the corrugation situated on the outside of the bend, the outer imprint side surface having a longitudinal axis parallel to the longitudinal axis of the inner imprint side surface, the hollow upper die being oriented or orientable relative to the bottom frame such that the longitudinal axes of the inner and outer imprint side surfaces form a bending angle with respect to the stationary portion of the projecting counter-form, the hollow upper die being coupled to the top frame in order to transmit the force of the press towards the bottom frame.

2. The device as claimed in claim 1, wherein the inner side half-die is mounted to as to be able to slide relative to the top frame, such that it can slide along an axis parallel to an actuation direction (P) of the press between a deployed position in which the inner side half-die (36) is offset towards the mounting surface relative to the outer side half-die and a retracted position in which the inner side half-die is aligned with the outer side half-die, and the outer side half-die is coupled to the top frame in order to transmit the force of the press towards the bottom frame, the inner side half-die being capable of sliding from the deployed position to the retracted position in contact with the bottom frame as the top frame lowers towards the bottom frame under the effect of the press.

3. The device as claimed in claim 1, further comprising two sidewall clamps carried by the top frame to either side of the hollow upper die and arranged between the top frame and the bottom frame, each sidewall clamp being mounted so as to be able to slide on the top frame along an axis parallel to an actuation direction (P) of the press, each sidewall clamp comprising a planar bottom surface parallel to the mounting surface of the bottom frame, the device further comprising return springs interposed between the top frame and the sidewall clamps in order to elastically return the sidewall clamps to a deployed position towards the bottom frame.

4. The device as claimed in claim 3, wherein the inner side half-die is mounted to as to be able to slide relative to the top frame, such that it can slide along an axis parallel to the actuation direction (P) of the press between a deployed position in which the inner side half-die (36) is offset towards the mounting surface relative to the outer side half-die and a retracted position in which the inner side half-die is aligned with the outer side half-die, and the outer side half-die is coupled to the top frame in order to transmit the force of the press towards the bottom frame, the inner side half-die being capable of sliding from the deployed position to the retracted position in contact with the bottom frame as the top frame lowers towards the bottom frame under the effect of the press, and wherein a first of the sidewall clamps is adjacent to the inner side half-die and engages with the inner side half-die in order to keep the bottom surface of the inner side half-die aligned with the bottom surface (60) of the first sidewall clamp and elastically return the inner side half-die to the deployed position of the inner side half-die under the effect of the return springs.

5. The device as claimed in claim 3, wherein the return springs are gas lift cylinders.

6. The device as claimed in claim 1, further comprising a guide block arranged between the top frame and the bottom frame and mounted pivoting on the top frame about an axis perpendicular to the mounting surface, the hollow upper die being mounted on the guide block such that the bending angle can be adjusted by pivoting the guide block relative to the top frame.

7. The device as claimed in claim 6, wherein a pivoting range of the guide block encompasses bending angles situated to either side of a neutral orientation aligned with the stationary portion of the counter-form, and wherein each of the two half-dies is able to slide relative to the guide block, so as to be able to slide between a deployed position and a retracted position along an axis parallel to the actuation direction of the press, each of the two half-dies being able to act as the inner side half-die depending on the direction of the bending angle with respect to the neutral orientation.

8. The device as claimed in claim 7, wherein the guide block further comprises removable fasteners for selectively holding each of the two half-dies in the retracted position.

9. The device as claimed in claim 7, wherein each of the two sidewall clamps is arranged in such a way as to engage with the half-die adjacent to said sidewall clamp when, depending on the orientation of the guide block, the half-die adjacent to said sidewall clamp is the inner side half-die, such that, for both directions of the bending angle relative to the neutral orientation, the bottom surface of the inner side half-die is kept aligned with the bottom surface of the adjacent sidewall clamp and the inner side half-die is elastically returned to the deployed position under the effect of the return springs.

10. The device as claimed in claim 1, further comprising a link bar extending transverse to and above the stationary portion of the counter-form and linking the two sidewall clamps rigidly together.

11. The device as claimed in claim 1, wherein the movable portion of the counter-form has a cross-sectional shape that matches a cross-sectional profile of the corrugation that needs to be bent, the inner imprint side surface having a profile that matches a first cross-sectional half-profile of the corrugation that needs to be bent and the outer imprint side surface having a profile that matches a second cross-sectional half-profile of the corrugation that needs to be bent.

12. The device as claimed in claim 1, further comprising a shaft mounted pivoting in the bottom frame about an axis perpendicular to the planar mounting surface of the bottom frame, the shaft having a circular end surface aligned with the planar mounting surface, the movable portion of the counter-form having a first length portion attached to the end surface of the shaft along a radius of the circular end surface and a second length portion extending on the planar mounting surface in the continuation of the first length portion and in sliding contact with the planar mounting surface, the stationary portion of the counter-form being oriented in a direction intersecting with the center of the end surface, the stationary portion of the counter-form having a first length portion attached to the planar mounting surface and a second length portion extending on the end surface of the shaft in the continuation of the first length portion and in sliding contact with the end surface.

13. The device as claimed in claim 12, wherein the first length portion of the movable portion of the counter-form and the second length portion of the stationary portion of the counter form each extend towards the center of the end surface without reaching the center of the end surface, the end surface further carrying a central corrugation plate arranged between the movable portion and the stationary portion of the counter-form, the central corrugation plate being mounted pivoting on the end surface coaxially with the shaft, the dimensions of the cross section of the central corrugation plate being slightly smaller than the cross section of the movable portion of the counter-form.

14. The device as claimed in claim 13, further comprising a floating corrugation plate that has the same cross-sectional shape as the central corrugation plate and is arranged between the central corrugation plate and one of the movable portion and the stationary portion of the counter-form, the floating corrugation plate being linked to said one of the movable portion and the stationary portion with a degree of translational freedom along the axis of said one of the movable portion and the stationary portion and with a degree of freedom to pivot about an axis perpendicular to the mounting surface.

15. A sheet metal forming method configured to form a bend in a corrugation, the method comprising:

arranging a sheet metal plate on a bottom frame having a planar mounting surface and a projecting counter-form arranged on the mounting surface, the projecting counter-form having a stationary portion and a movable portion that is hinged, relative to the stationary portion, about an axis perpendicular to the mounting surface, the sheet metal plate having planar portions received on the mounting surface and a corrugation arranged between the planar portions, projecting relative to the planar portions and in which the projecting counter-form is accommodated, lowering a top frame arranged above the bottom frame towards the bottom frame, by means of a press, the top frame carrying a hollow upper die arranged above the movable portion of the projecting counter-form, the upper die comprising an inner side half-die that has a planar bottom surface parallel to the mounting surface and an inner imprint side surface configured to delimit a sidewall of the corrugation situated on the inside of the bend, the inner imprint side surface having a longitudinal axis parallel to the planar mounting surface, and an outer side half-die that has a planar bottom surface parallel to the mounting surface and an outer imprint side surface configured to delimit a sidewall of the corrugation situated on the outside of the bend, the outer imprint side surface having a longitudinal axis parallel to the longitudinal axis of the inner imprint side surface, the hollow upper die being oriented relative to the bottom frame such that the longitudinal axis of the inner and outer imprint side surfaces forms a bending angle with respect to the stationary portion of the projecting counter-form and, during the lowering movement of the top frame:

bringing the outer imprint side surface, initially via the bottom edge of same, into contact with the top of an outer sidewall of the corrugation, sliding the outer imprint side surface downwards against the outer sidewall of the corrugation, so as to push the outer sidewall of the corrugation in the bending direction, turn the movable portion towards an end position aligned with the longitudinal axis of the outer imprint side surface, and thus push the inner sidewall of the corrugation in the bending direction, wherein the corrugation is deformed by a sliding contact against the movable portion, such that the sheet metal plate is unwound behind the outer sidewall and wound up in front of the inner sidewall of the movable portion.

16. The method as claimed in claim 15, further comprising the step of clamping the planar portions of the sheet metal plate against the mounting surface by means of sidewall clamps.

17. The method as claimed in claim 15 using a forming device, wherein:

in an initial state, a sheet metal plate is positioned on the planar mounting surface and the projecting counter-form is accommodated in the corrugation that needs to be bent, the movable portion of the projecting counter-form has an initial position, and the hollow upper die is oriented relative to the top frame such that the longitudinal axis of the imprint side surfaces forms a bending angle with respect to the movable portion of the projecting counter-form in the initial position, then, when the top frame is lowered towards the bottom frame under the effect of the press:

a bottom edge of the outer side half-die comes into contact with a crest portion of the corrugation that needs to be bent and the imprint side surface of the outer side half-die slides against an outer sidewall of the corrugation that needs to be bent so as to press the outer sidewall of the corrugation that needs to be bent against the outer sidewall of the movable portion, from the crest to the trough of the corrugation, so as to shape the outer sidewall of the corrugation that needs to be bent to the outer sidewall of the movable portion, and simultaneously turn the movable portion from the initial position to an end position aligned with the imprint side surfaces of the two half-dies of the hollow upper die, in an end state, a longitudinal portion of the corrugation that needs to be bent is sandwiched between the movable portion of the projecting counter-form and the hollow upper die and is bent by an angle equal to said bending angle with respect to the initial state.

18. The method as claimed in claim 17, wherein the inner side half-die in the deployed position comes into contact first with the sheet metal plate at a distance from an inner blank of the corrugation that needs to be bent, and the inner side half-die then slides towards the retracted position as the top frame lowers towards the bottom frame.

19. The method as claimed in claim 15, wherein the initial position of the movable portion of the projecting counter-form is aligned with the stationary portion, the corrugation that needs to be bent having a straight shape in the initial state.

20. The method as claimed in claim 15, wherein the initial position of the movable portion of the projecting counter-form is turned by an initial angle relative to the stationary portion, the corrugation that needs to be bent having a shape bent by the initial angle in the initial state and a shape bent by an angle equal to the sum of the initial angle and the bending angle in the end state.

21. The device as claimed in claim 1, wherein the projecting counter-form further has a third portion that is hinged, relative to the movable portion, about a second axis perpendicular to the mounting surface, the device further comprising a second top frame arranged above the bottom frame and configured to be actuated towards the bottom frame by a press, a second hollow upper die carried by the second top frame between the second top frame and the bottom frame, the second hollow upper die being arranged above the third portion of the projecting counter-form.

22. The device as claimed in claim 21, wherein the first top frame and the second top frame of the forming device are arranged under the press so as to be lowered simultaneously towards the bottom frame in order to produce two bends with a single stroke of the press.

* * * * *